US006036269A

United States Patent [19]

Colton

[11] Patent Number: 6,036,269

[45] Date of Patent: Mar. 14, 2000

[54] COLLAPSIBLE FOOTSTOOL

[76] Inventor: Jonathan S. Colton, 2275 Fairhaven Cir., NE., Atlanta, Ga. 30305

[21] Appl. No.: 09/013,577

[22] Filed: Jan. 27, 1998

[51] Int. Cl.[7] ..... A47C 7/00

[52] U.S. Cl. ..... 297/440.12; 297/423.41

[58] Field of Search ..... 297/440.12, 440.1, 297/423.39, 423.41; 248/152, 174, 247, 248, 346.4

[56] References Cited

U.S. PATENT DOCUMENTS

| | | |
|---|---|---|
| 1,252,073 | 1/1918 | Achert . |
| 1,438,963 | 12/1922 | Miller . |
| 2,091,951 | 9/1937 | Anthony . |
| 2,240,024 | 4/1941 | Stone et al. . |
| 2,244,912 | 6/1941 | Kollander . |
| 2,454,877 | 11/1948 | Lewis . |
| 4,632,302 | 12/1986 | Manizza . |
| 4,705,173 | 11/1987 | Forbes, Jr. . |
| 4,757,937 | 7/1988 | Maio . |
| 4,804,230 | 2/1989 | Friedman . |
| 4,832,257 | 5/1989 | Wood . |
| 4,841,882 | 6/1989 | Ehrman . |
| 4,872,723 | 10/1989 | Kopf . |
| 5,379,891 | 1/1995 | Coleman . |
| 5,489,144 | 2/1996 | Lewis . |
| 5,829,729 | 11/1998 | Welch et al. . |

OTHER PUBLICATIONS

Totes Advertisment.

*Primary Examiner*—Milton Nelson, Jr.
*Attorney, Agent, or Firm*—Technoprop Colton LLC

[57] ABSTRACT

A foldable plastic or laminated paperboard footstool which can be used for resting an individual's feet and which can be easily assembled from a plastic or laminated paperboard, or corrugated plastic or paperboard blank.

18 Claims, 8 Drawing Sheets

COLLAPSIBLE FOOTSTOOL

BACKGROUND OF THE INVENTION

1. Field of the Invention

The present invention relates generally to a foldable footstool, and, more specifically, to a plastic or laminated paperboard, or corrugated plastic or paperboard footstool to help alleviate the discomfort associated with long sitting hours, which footstool is preferably foldably constructed from a flat, cut blank to form a portable footstool having a lightweight construction. The present invention is convenient to carry and store, and eliminates the need for glue or bulky fasteners for its assembly and disassembly.

2. Description of Related Art

Folded paperboard and corrugated paperboard containers have been developed for a variety of uses. For example, disposable concession trays, such as those disclosed by U.S. Pat. No. 4,705,173 to Forbes, Jr., and U.S. Pat. No. 4,757,937 to Maio, et al., have been found to provide inexpensive and disposable carriers for transporting food and drink. These folded paperboard carriers are typically fabricated from a die-cut paperboard blank, which can be stored in a flat configuration, in order to minimize space requirements during shipping and prior to their use by the consumer. The paperboard blanks are typically configured in a manner which permits quick and easy assembly into their erected configurations when placed into use.

U.S. Pat. No. 4,632,302 to Manizza shows a folded panel baking tray wherein the tray's corners comprise an open slot between upright side walls, resulting from the tray's assembly from a blank having a generally rectangular corner cutout. It has been recognized that containers such as that disclosed by the Manizza reference suffer the disadvantage that gluing of certain panels is necessary to assemble the container. Such gluing results in additional time and expense to assemble the container from the blank, and are avoided by the present invention. Further, such gluing limits disassembly, an important feature of the present invention.

U.S. Pat. No. 4,832,257 to Wood shows a paperboard tray having folded corners requiring no cut lines or openings. However, in order to retain this tray in its assembled configuration, it is necessary to adhesively secure the corner assemblies in their upright configuration. The necessity of gluing disadvantageously requires additional time and expense in the assembly of this tray. Also, because the corner assemblies must be glued to retain the tray in its upright configuration, the tray cannot readily be knocked down into a generally flat configuration for more easy access to the contents of the tray, without substantially damaging the tray. Thus, the tray disclosed by this reference is not suitable for applications in which it is desired to periodically disassemble and reassemble the tray. Moreover, the corner assemblies of this variety of tray are typically glued in the assembled configuration at their point of manufacture. Therefore, the blanks cannot be shipped to their point of use in a flat, unfolded configuration.

Portable footstools also are known to exist. U.S. Pat. No. 5,379,891 to Coleman discloses a footstool structure for use by guitar players to elevate a foot and leg to provide a rest position for a guitar while playing the instrument. It is designed such that it can be carried and stored in a traditional guitar carrying case designed for primarily carrying a guitar. The footstool structure provides vertical height adjustment and comprises a foot support member, a first leg structure attached to said foot support member, and a second leg structure wherein an elevational adjustment mechanical arrangement is incorporated. Yet, the Coleman device is not lightweight or prepared from a plastic, corrugated plastic, paperboard or corrugated paperboard material, nor can it collapse into a lightweight, portable flat structure for ease of carrying.

U.S. Pat. No. 5,489,144 to Lewis discloses a portable folding footstool for supporting the legs of an individual relative to a ground surface. The footstool has a support member receiving the individual's legs thereon, and a folding leg assembly for positioning the support member above the ground surface which can be folded flatly against the support member for storage and transportation purposes. The Lewis device comprises a pair of substantially rectangular leg members which are pivotally coupled to opposed longitudinal ends of the support means incorporating an elongated traverse aperture in the leg members which permits the passage of a pivot pin. Lewis similarly cannot be comprised of a substantially flat paperboard lightweight structure, and further has several movable parts which the present invention overcomes by replacing with, in the preferred embodiment, a single foldable paperboard blank.

Therefore, it can be seen that a need exists for a foldable plastic or paperboard, or corrugated plastic or paperboard, footstool, and which can be easily erected by folding and be disassembled in the same manner. It is to the provision of such a footstool, and a blank for foldably constructing such a footstool, that the present invention is primarily directed.

BRIEF SUMMARY OF THE INVENTION

Briefly described, in its preferred form, the present invention comprises a foldable footstool constructed of plastic or paperboard, or corrugated plastic such as Coroplast® or paperboard. Preferably, corrugated plastic or foamed plastic sheet or board is used as the material of construction. Unless otherwise indicated, the term "paperboard" used herein will also include corrugated paperboard, cardboard and other like foldable materials. The device is foldably constructed from a flat blank of the material to form a closed-top device (i.e. footstool) which can be used for resting one's feet upon. The present invention also comprises a laminated blank for fabricating such a footstool.

The foldable laminated footstool of the present invention preferably comprises a top portion and a foldably attached crossing bottom assembly wherein slots or the equivalent provided in crossing members of the bottom crossing allow for the foldably attached crossing bottom assembly to securedly assemble into a rigid-like assembled position. The crossing bottom assembly of the present invention preferably comprises four crossing members. Each crossing member has a slot of sufficient width so that, upon assembly, each crossing member can foldably cross under the top portion of the footstool, and become securedly fixed within the slots of other crossing members.

The footstool of the present invention preferably also comprises fastening means for further securing the crossing members in a flat configuration for carrying. The fastening means prevents the unintentional unfolding of the crossing bottom assembly. In the preferred embodiment, the fastening means are hook and loop means, or Velcro® strips, located on the crossing members for engaging complementary strips for fastening.

The blank from which the footstool of the present invention is assembled also may be a laminate of paperboard or corrugated paperboard with a top and bottom face liner surface of plastic film. The preferred top and bottom face liner material is a polyester film laminated to the paperboard material by a low-density polyethylene, which functions as an adhesive.

Accordingly, it is an object of the present invention to provide a foldable footstool which is lightweight, stable, sturdy, and inexpensive.

It is another object of the present invention to provide a foldable footstool which is durable and can be assembled and disassembled without significant loss of integrity.

Still another object of the present invention is to provide a blank which can be quickly and easily assembled into a footstool without the necessity of gluing or otherwise permanently attaching any components thereof.

Another object of the present invention is to provide a retaining slot fastening mechanism which will not be damaged by assembly and disassembly of the blank, and where such fastening mechanism is very easy to operate.

Yet another object of the present invention is to provide a foldable footstool having a top portion and a crossing bottom assembly, which footstool can be fabricated by folding a flat blank into an assembled state, without the need for glue or other adhesives, and which can be disassembled and reassembled without causing damage to the blank.

Still another object of the present invention is to provide a footstool which can be shipped and bought in a flat, unitary blank form. Additionally, the user can disassemble the laminated footstool and store it in the flat configuration.

These objects and other objects, features and advantages of the present invention will become more apparent upon reading the following specification in conjunction with the accompanying drawing figures.

DETAILED DESCRIPTION OF A PREFERRED EMBODIMENT

Figure 1:
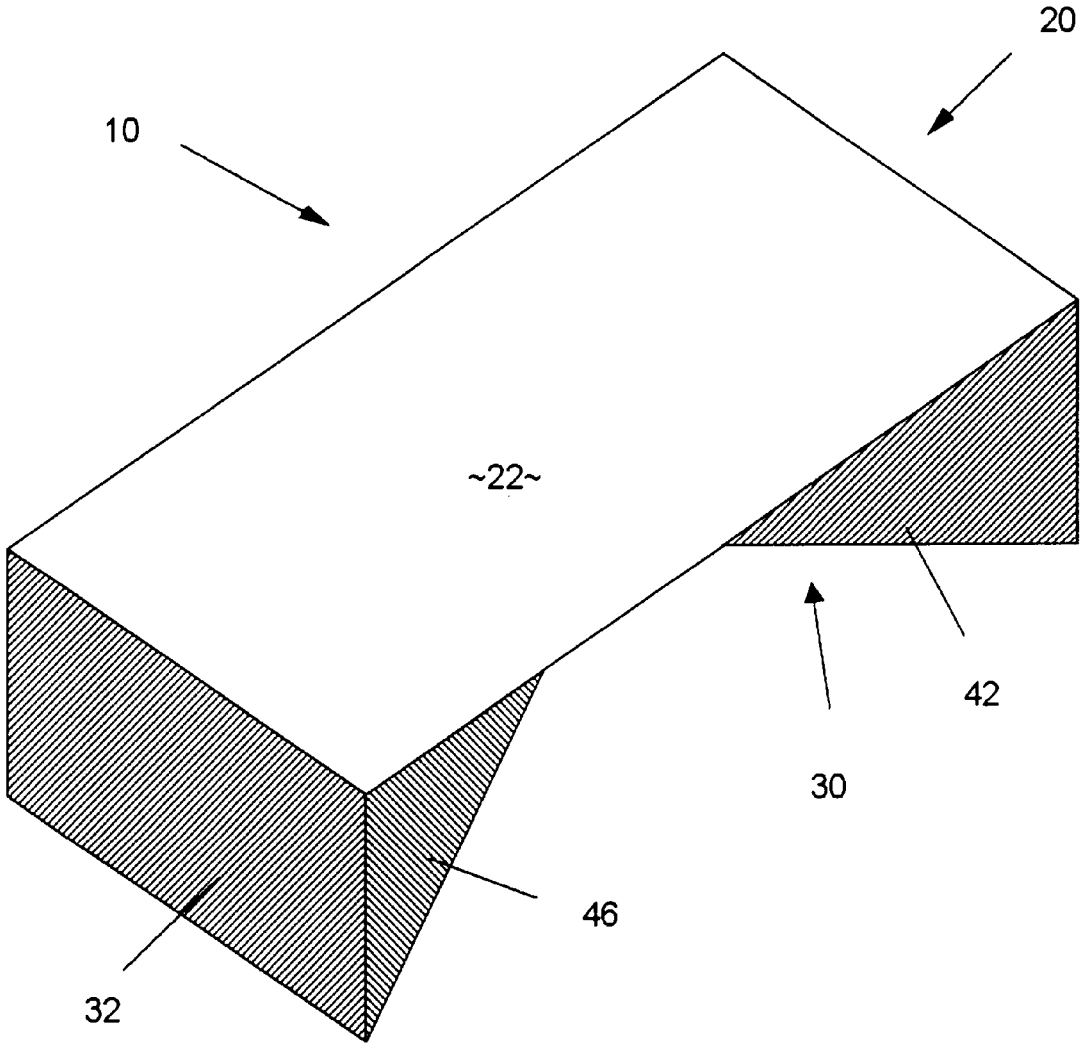
FIG. 1 is a perspective view of the foldable footstool of the present invention, in its assembled configuration and according to the preferred embodiment.
Figure 2:
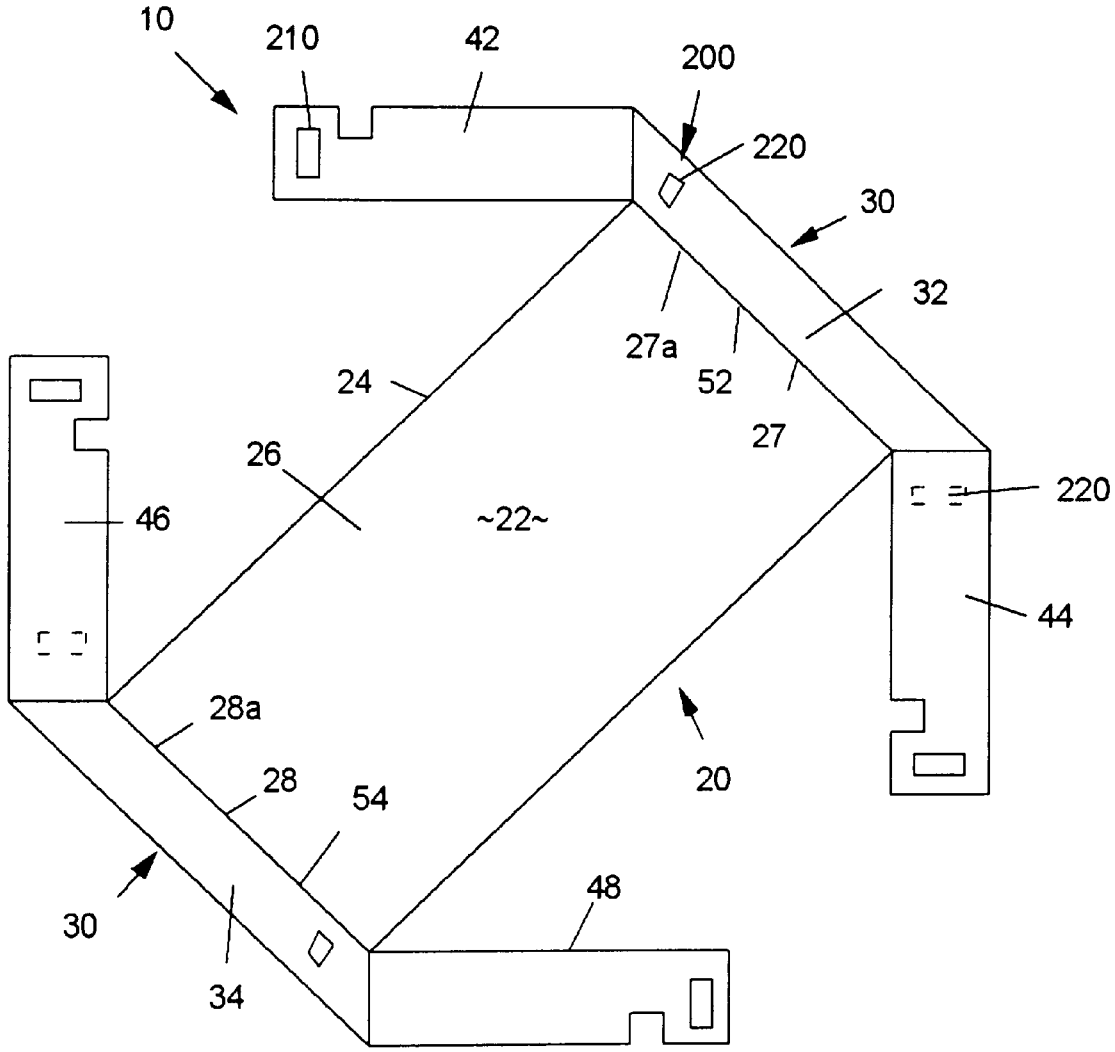
FIG. 2 is a perspective view of the foldable footstool of FIG. 1, shown in a partially assembled configuration.
Figure 5:
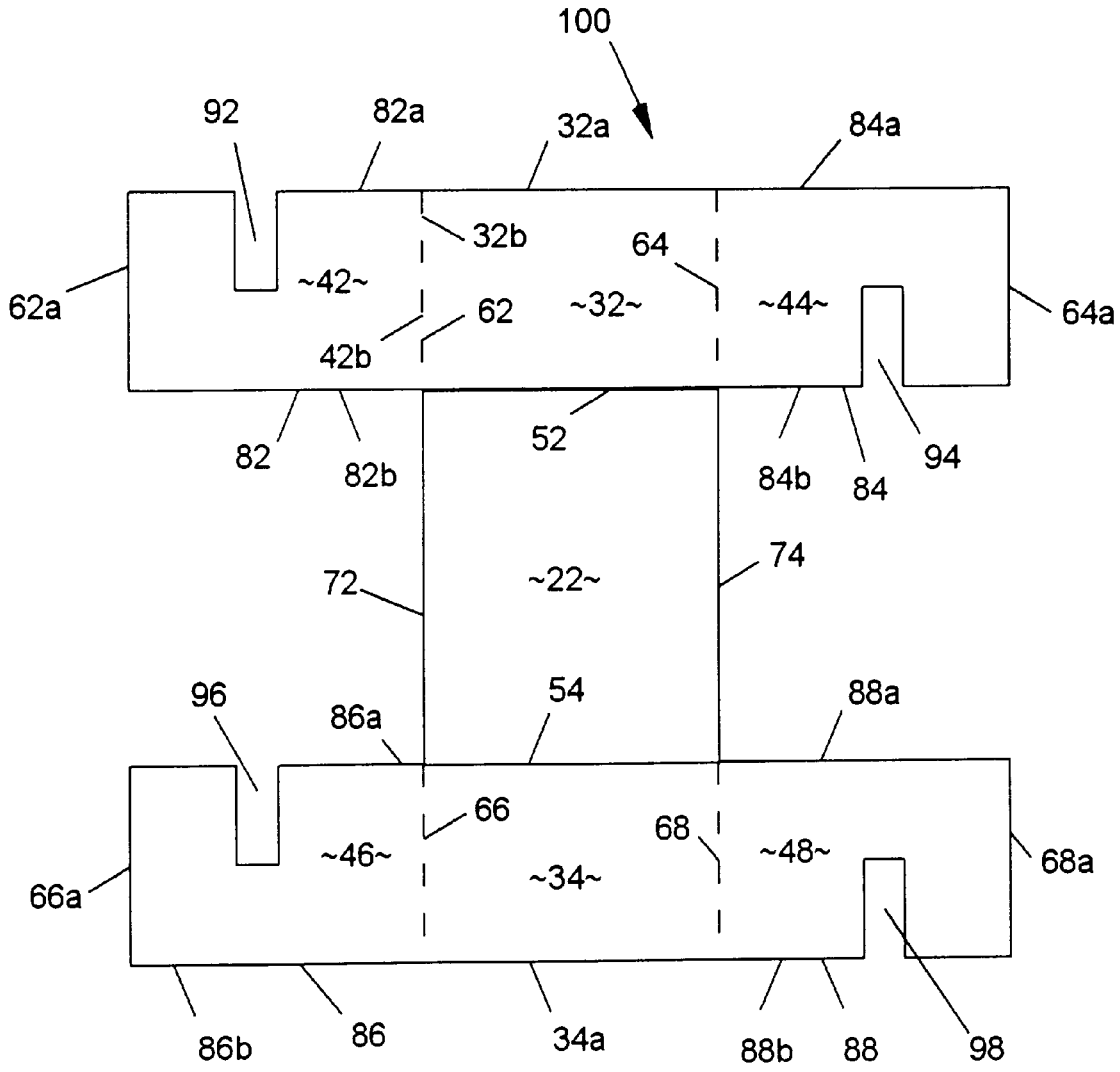
FIG. 5 is a plane view of a laminated paperboard blank of the present invention according to FIG. 1.

Referring now in detail to the drawing figures, wherein like reference numerals represent like parts throughout the several views, FIGS. 1 and 2 show the folded footstool 10 of the present invention, which generally comprises a top portion 20 and a foldably attached bottom crossing assembly 30. In preferred form, the top portion 20 and the bottom crossing assembly 30 of the footstool 10 are foldably designed from a single, unitary blank 100, as shown in FIG. 5.

FIG. 2 is a perspective view of the partially assembled footstool 10 upside-down. The top portion 20 preferably comprises top panel 22, and the bottom crossing assembly 30 preferably comprises first and second end panels 32, 34, and crossing members 42, 44, 46 and 48.

In preferred form, top panel 22 forms a generally square-shaped structure. Top panel 22 has a top face 24 and a bottom face 26. In the upright, assembled state of the present invention, top face 24 of top panel 22 becomes the footrest section of footstool 10. That is, when the footstool 10 is in use, the user's feet will rest and be supported upon top face 24 of top section 22.

Bottom crossing assembly 30 preferably comprises first and second end panels 32, 34. As shown in FIG. 2, the first and second end panels 32, 34 are foldably connected to the top and bottom edges 27, 28 of top panel 22 at bottom edge 27*a* of first end panel 32 and top edge 28*a* of second end panel 34 at first and second bend lines 52, 54, respectively. This foldable connection forms a "hinge" joint which enables the first and second end panels 32, 34 to be folded in various configurations. For example, first and second end panels 32, 34 may be folded flat to allow for the easy shipping of the present invention 10 as a flat, unitary blank 100, or folded to form the bottom crossing assembly 30 of the footstool 10. Further, as seen best in FIG. 2, the top portion 20 will not deform upon the folding and unfolding of bottom crossing assembly 30 of the foldable footstool 10. In preferred form, end panels 32, 34 can fold at bend lines 52, 54 from a shipping configuration, to an assembled configuration, and lastly to a carrying configuration.

Bottom crossing assembly 30 further preferably comprises crossing members 42, 44, 46, 48. As shown in FIG. 5, crossing member 42 is foldably connected to the first side edge 32*b* of first end panel 32 at first side edge 42*b* of crossing member 42 at line of folding 62. Similarly, although unreferenced, each first side edge of each crossing member is foldably attached one each to said first and second side edges of first and second end panels 32, 34.

While in preferred form the present invention can be assembled from a single, unitary blank 100, it will be understood by one skilled in the art that other embodiments of the present invention will also form the footstool 10 of the present invention. For example, the components of the present invention (i.e., end panels 32, 34 and crossing members 42, 44, 46, 48) may be connected to other components of the present invention in a variety of ways. In preferred form all components are foldably connected to other components, as shown in FIG. 3*c*. In the following examples of possible variations of "hinge" joints, for simplicity, attention will be focused to the connection of top panel 22 to end panel 32 as a representative sample, which in preferred form, comprises a foldable connection via bend line 52.

Figure 3A:
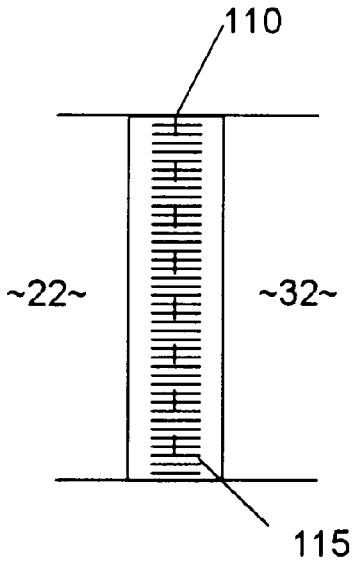
FIG. 3*a* is a top plane view of a stitching method for joining sections of the footstool according to one form oft he present invention.
Figure 3B:
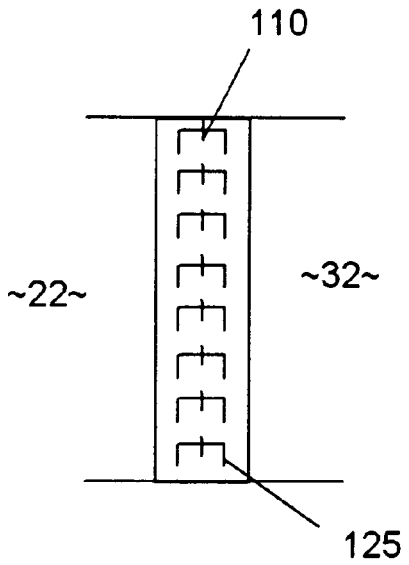
FIG. 3*b* is a top plane view of a stapling method for joining the sections of the footstool according to another embodiment of the present invention.
Figure 3C:
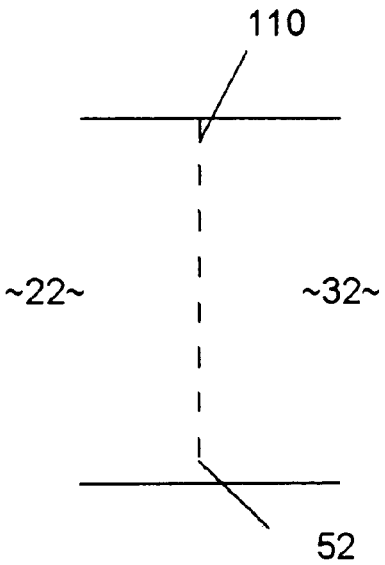
FIG. 3*c* is a top plane view of a folding method for joining sections of the footstool according to another embodiment of the present invention.
Figure 3D:
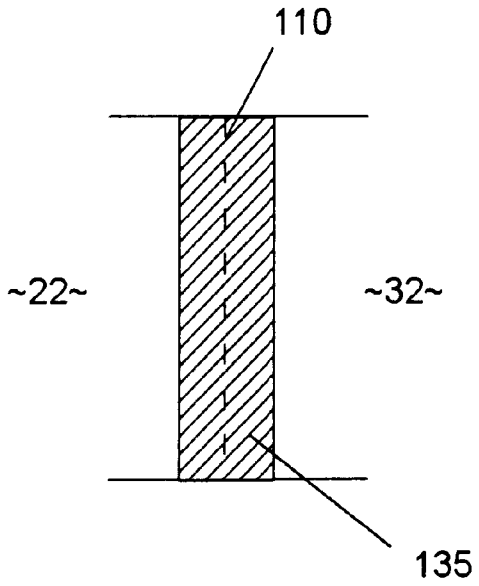
FIG. 3*d* is a top plane view of an adhesive method for joining sections of the footstool according to another embodiment of the present invention.

Methods for joining or folding the components of footstool 10 are shown in FIGS. 3*a*–3*d*. In FIG. 3*a*, top panel 22 and end panel 32 are formed of separate sheets, and overlap slightly at spine 110. A line of stitching 115 joins panels 22 and 32, wherein panels 22 and 32 lay one atop the other in a region around spine 110 shown between the two solid lines bracketing spine 110. In FIG. 3*b*, panels 22 and 32 are formed of separate sheets, and overlap slightly at spine 110. A line of staples 125 joins panels 22 and 32, panels 22 and 32 laying one atop the other in a region around spine 110 shown between the two solid lines bracketing spine 110. In FIG. 3*c*, panels 22 and 32 are formed of one continuous sheet wherein the sheet is folded about spine 110. The line of folding 52 creates panels 22 and 32. Finally, in FIG. 3*d*, panels 22 and 32 are formed of separate sheets, and overlap slightly at spine 110. A zone of adhesive, area 135, joins panels 22 and 32, panels 22 and 32 laying one atop the other in a region around spine 110 shown between the two solid lines bracketing spine 110. It will be understood by one of ordinary skill in the art that FIGS. 3*a*–3*d* represent only a few examples for methods for joining or folding the components of footstool 10, and that several other means for joining or folding the components of footstool 10 exist in various forms, although equivalent to those described. For example, other methods for joining components of footstool 10 to each other may include using tape, solvent bonding, and other mechanical and chemical methods.

In the shipping configuration, all the elements of the present invention 10, top panel 22, end panels 32, 34, and crossing members 42, 44, 46, 48 lie flat in the same plane. The shipping configuration allows for easy stacking of the unitary blank 100 of the present invention 10, thus enabling for easy and optimum shipping.

The assembled configuration, discussed in greater detail below, comprises the present invention 10 in its assembled state, that being a supported footrest 24, wherein end panels 32, 34 and crossing members 42, 44, 46 and 48 fold generally 90 degrees relative to top panel 22, thus into a perpendicular plane to top panel 22.

In the carrying configuration, end panels 32, 34 are folded 180 degrees about bend lines 52, 54, and crossing members 42 and 44 are folded and tucked under first end panel 32, and crossing members 46 and 48 are folded and tucked under second end panel 34. In this configuration, the entire apparatus 10 folds into a configuration no larger than top panel 22 for ease of carrying and storing.

Additionally, a fastening means 200 can be provided in bottom crossing assembly 30 for engaging portions of crossing members 42, 44, 46 and 48 in the carrying configuration. In preferred form, fastening means 200 comprises a hook and loop fastening means shown generally as hook strip 210 on crossing member 42, and complimentary loop strip 220 on crossing member 44, for example, Velcro® attachments.

The footstool 10 of the present invention is preferably constructed by folding a one-piece blank 100, which is shown in the preferred form in FIG. 5. The preferred blank 100 is die-cut and scored, according to known techniques, from a flat sheet of laminated material, which material will be described in greater detail below. Other cutting techniques can be used, such as knife-cutting, razor-cutting, and the like. The blank 100 has top panel 22 defined by the generally square area bordered by side edges 72, 74 and bend lines 52, 54. First end panel 32 is hingedly attached to top panel 22 by bend line 52. Crossing members 42, 44 are foldably attached to first end panel 32 about lines of folding 62, 64. Similarly, second end panel 34 is hingedly attached to top panel 22 by bend line 54. Crossing members 46, 48 are foldably attached to second end panel 34 about lines of folding 66, 68.

The first and second end panels 32, 34 and crossing members 42, 44, 46, 48 are generally identical mirror images of one another. Therefore, for purposes of brevity, at times only one end panel or crossing member may be described in detail. It will be understood by those of ordinary skill in the art that both end panels and each crossing member are of similar construction, and differ only in orientation, as shown in the drawing figures.

The length of crossing members 42, 44, 46 and 48, represented as the length of bottom edges 82, 84, 86 and 88, respectively, are generally approximately equal to the length of bend lines 52, 54, which themselves are equal. The width of crossing members 42, 44, 46 and 48, represented as the length of lines of folding 62, 64, 66 and 68, respectfully, are generally approximately equal to one half of the length of side edges 72, 74 which, too, are equal. Therefore, the total length represented by the lengths of bottom edges 82, 84 and bend line 52 is approximately three times the length of bend line 52. Additionally, the total length represented by the lengths of fold lines 62, 66 and side edge 72 is approximately twice the length of side edge 72 itself. This allows for ease of manufacture and less waste during the manufacturing process. Other lengths and widths are contemplated and suitable, and the invention is not so limited.

Figure 8:
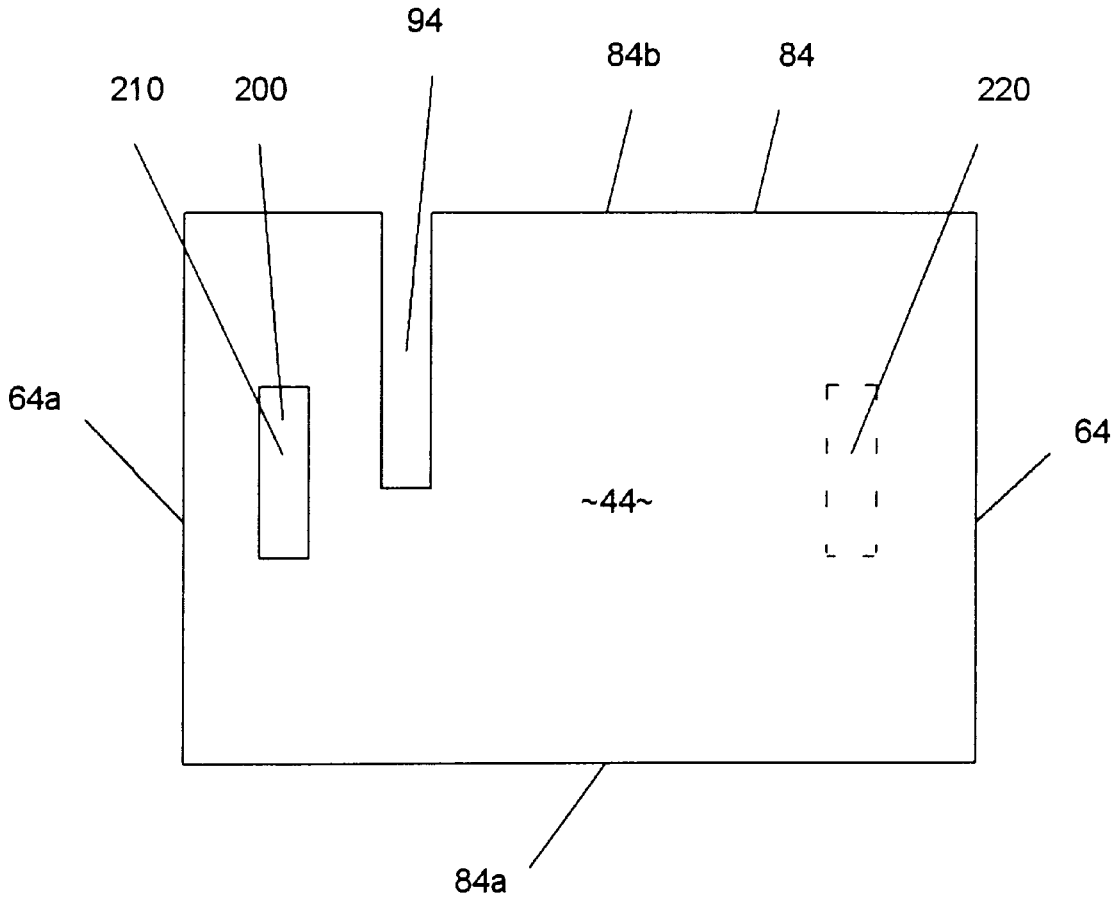
FIG. 8 shows in greater detail a crossing member of the present invention.

Crossing members 42, 44, 46 and 48 have slots 92, 94, 96 and 98 respectively. While slots 92, 94, 96 and 98 have generally equal dimensions, slots 92, 96 are orientated on similar locations on crossing members 42, 46, as opposed to slots 94, 98 which are orientated on similar locations on crossing members 44, 48. A representative crossing member, crossing member 44, is shown in FIG. 8.

Slots 92, 96 are cut into crossing members 42, 46 extending from top edges 82*a*, 86*a* to generally half way through the width of crossing members 42, 46, that being a length of approximately one half the length of lines of folding 62, 66. Additionally, the width of slots 92, 96 preferably are generally slightly greater than two times the thickness of the paper blank 100. Further, slots 92, 96 preferably are generally located two-thirds the distance of length of bottom edges 82, 86 from lines of folding 62, 66, wherein slots 92, 96 are twice as close to second side edges 62*a*, 66*a* as to lines of folding 62, 66.

Similarly, slots 94, 98 are cut into crossing members 44, 48 extending from bottom edges 84, 88 to generally half way through the width of crossing members 44, 48, that being a length of approximately one half the length of lines of folding 64, 68. Additionally, the width of slots 94, 98 are preferably generally slightly greater than two times the thickness of the paper blank 100. Further, slots 94, 98 are preferably generally located two-thirds the distance of length of bottom edges 84, 88 from lines of folding 64, 68, wherein slots 94, 98 are twice as close to second side edges 64*a*, 68*a* as lines of folding 64, 68.

Slots 92, 94, 96, 98 are located such that they will cooperate with each other when assembling the footstool 10 as disclosed below.

Figure 4:
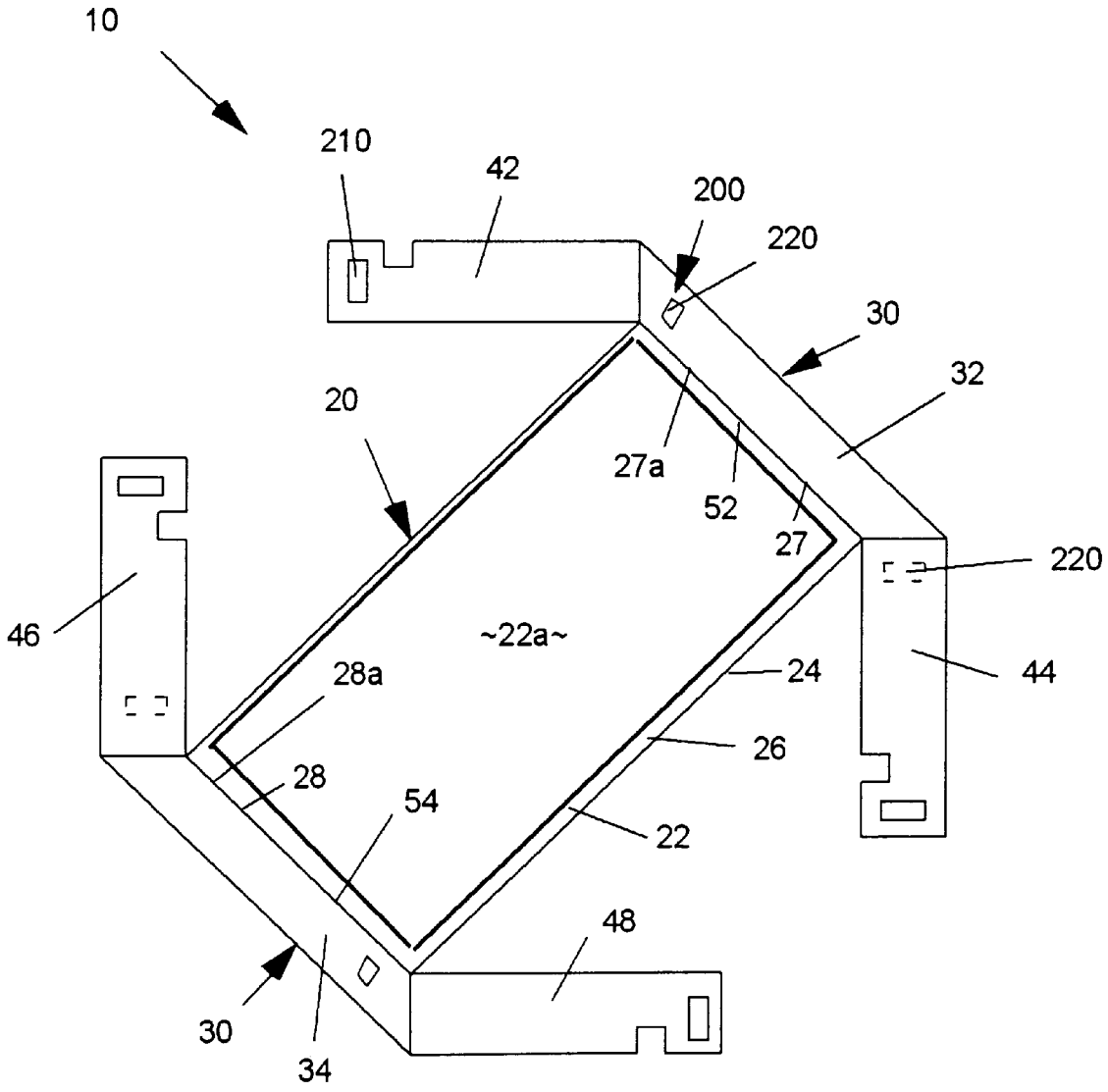
FIG. 4 is a perspective view of another embodiment of the present invention shown in a partially assembled configuration.
Figure 6:
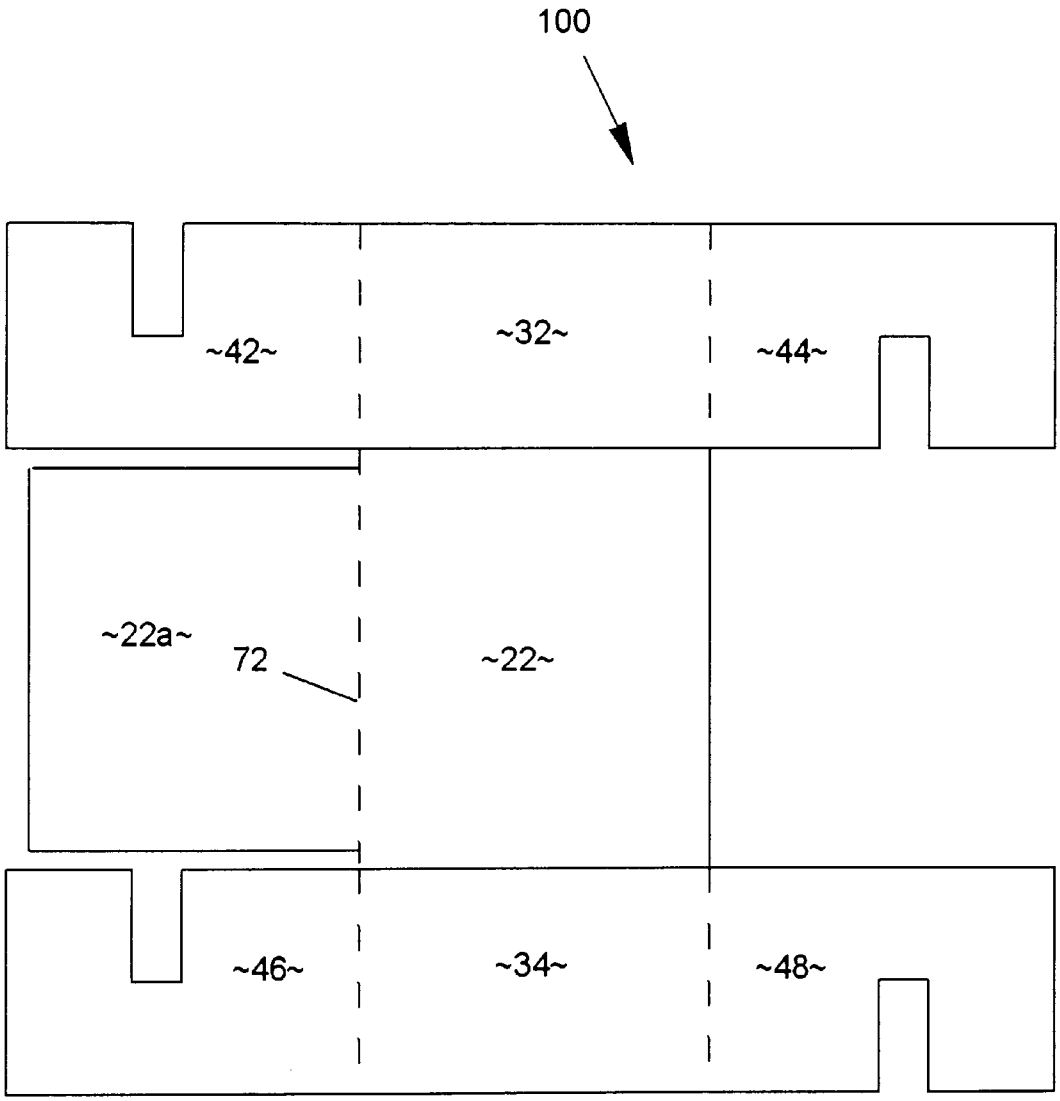
FIG. 6 is plane view of the laminated paperboard blank according to FIG. 4.

Several other embodiments of the present invention exist. In one embodiment of the present invention, the footrest section of footstool 10 is further supported by a bottom panel 22*a* which is securedly attached to the top panel 22 about side edge 72. As shown in FIG. 6, this bottom panel 22*a* is of the same general size and shape as top section 22, wherein bottom panel 22*a* can be foldably fit upon bottom face 26 of top panel 22, thereby creating a double thick footrest section. FIG. 4 shows a perspective view of a partially assembled double-thick configuration.

Figure 7:
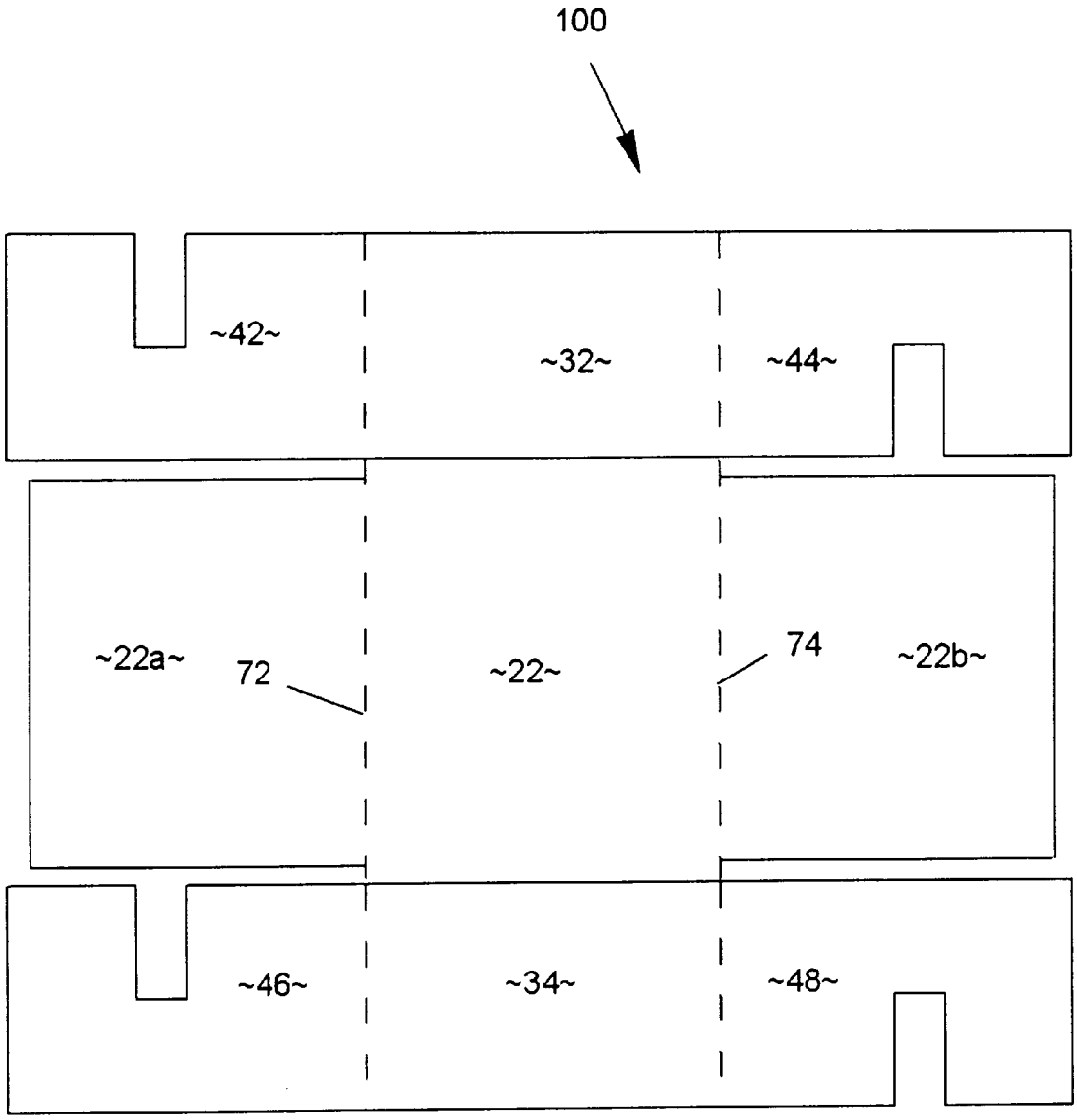
FIG. 7 is a plane view of a laminated paperboard blank according to another embodiment of the present invention.

Similarly, in another embodiment of the present invention shown in FIG. 7, a second bottom panel 22*b* may be fixedly secured to top panel 22 about edge 74 of top panel 22. Second bottom panel 22*b* has approximately the same dimensions as top panel 22, and may be added for additional support of top panel 22 and bottom panel 22*a*. It will be understood by one of ordinary skill in the art, that bottom panels 22*a* and 22*b* may be joined to top panel 22 by those methods for joining or folding as described in FIGS. 3*a*–3*d*, or other equivalent methods, or bottom panels 22*a*, 22*b* may be fixedly secured to the bottom face 26 of top panel 22, as additional, separate elements of footstool 10.

Further, as described in more detail below, slots 92, 94, 96 and 98 may be replaced with various other releasable attaching means, for example, velcro or snaps, to accomplish the assembled configuration of the bottom crossing members 42, 44, 46 and 48.

While the present invention is preferably constructed from a flat, die-cut blank, it will understood by those of ordinary skill in the art that a generally flat, contiguous blank may be pared down through knife cuts, razor blade cuts, and the like, to produce the various configurations of blank 100 described herein.

Construction of the Footstool

The blank 100, shown best by FIG. 5, can be fabricated from a laminate material comprising plastic films bonded to a plastic or paperboard, or corrugated plastic or paperboard substrate. In the preferred embodiment, the laminated plastic or paperboard substrate is an E-fluted corrugated plastic or paperboard, but other materials may be substituted, for example, A-, B-, C-, D-, E, or F-fluted, or micro-corrugated paperboard, or other foldable materials. Lamination of the substrate can be completed before or after fluting, but lamination should be completed before scoring and cutting the blank 100. An extruded plastic material, such as Coroplast®, which consists of top and bottom faces, connected by multiple parallel ribs, is another suitable material.

The blank 100, as described above, can be foldably constructed to form the footstool 10 as will now be described in greater detail. FIG. 2 shows the footstool 10 in a partially assembled configuration. As shown in FIG. 5, in the shipping configuration, all of the elements of the present invention 10, top panel 22, first and second end panels 32, 34, and crossing members 42, 44, 46, 48 lie flat in the same plane.

The paperboard blank 100 of the present invention may be folded from the shipping configuration to the assembled configuration quickly and easily. The first and second end panels 32, 34 are first folded upwards relative to the top panel 22, along bend lines 52, 54, into a position generally perpendicular to the top panel 22. In the preferred form, when the first and second end panels 32, 34 and the crossing members 42, 44, 46 and 48 are in the assembled position, the end panels 32, 34 and crossing members 42, 44, 46 and 48 will lie in planes generally perpendicular to the top panel 22, whereby the top face 24 of top panel 22 becomes the foot rest section of footstool 10.

After folding end panels 32, 34 about bend Lines 52, 54, crossing members 42, 44, 46 and 48 are then folded inward so as to be non-coplanar with end panels 32, 34 about lines of folding 62, 64, 66 and 68. The crossing members are folded inward from their respective end panels so that the crossing members of one end panel fold inward toward the other end panel. Crossing members 42, 48 are further folded about lines of folding 62, 68 toward each other wherein their respective slots 92, 98 line up over bottom face 26 of top panel 22. This continued folding is best accomplished by keeping edges 82*b*, 88*a* in proximity to, and sliding upon, bottom face 26 of top panel 22.

While holding crossing members 42, 48 in the above configuration, crossing members 44, 46 are next further folded inward about fold lines 64, 66 so that slots 94, 96 fit within oppositely oriented slots 92, 98. This can be accomplished by lifting crossing members 44, 46 away from bottom face 26 of top panel 22 and then returning crossing members 44, 46 after said slots are resting within their corresponding slots.

The bottom crossing assembly 30 of the footstool 10 is now rigidly fixed in a generally box-like configuration, whereupon flipping footstool 10 over, top face 24 of top panel 22 now comprises the footrest section of the footstool 10, and edges 82*a*, 84*a*, 86*b* and 88*b* of crossing members 42, 44, 46, and 48 and outer edges 32*a*, 34*a* of first and second end panels 32, 34, are in contact with the floor at the location where the footstool 10 is to be used.

A footstool comprising the additional elements of bottom panels 22*a*, 22*b* fixedly secured to the bottom face 26 of top panel 22 can be formed in similar fashion as described above, wherein, for example, bottom panel 22*a* lies in proximity to top panel 22 at the bottom face 26 of top panel 22.

Should it be necessary to disassemble the bottom crossing assembly 30 to place the present invention into the carrying configuration, such disassembly can be accomplished without damaging the blank 100, simply by retracting crossing members 42, 44, 46 and 48 from the assembled configuration.

In the carrying configuration, end panels 32, 34 are returned to the parallel plane of the shipping configuration, described above. Next, crossing member 44 is folded about line of folding 64, 180 degrees until crossing member 44 lies atop end panel 32. As described above, fastening means 200 can be provided in bottom crossing assembly 30 for engaging portions of crossing members 42, 44, 46, 48 in the carrying configuration. To this end, fastening means 200 can be located anywhere suitable on footstool 10 to facilitate the assembly of the footstool 10 into the carrying configuration. Through fastening means 200, crossing member 44 is releasably attached to end panel 32. Crossing member 42 is then folded about line of folding 62 180 degrees, and lies atop crossing member 44. Crossing member 42 is releasably secured to crossing member 44 by the fastening means 200. This configuration is repeated with crossing members 46, 48 and end panel 34. The present invention may further be folded wherein end wall 32 and crossing members 42, 44 are further folded about bend line 52 and end wall 34 and crossing members 46, 48 are folded about bend line 54 so that in the carrying configuration, the entire apparatus 10 folds into a configuration no larger than top panel 22 for use for carrying and storing.

In use, the above described blank 100 can be assembled to form the footstool 10 as described, according to the above described assembly methods. The footstool 10 can then be used for use as a footstool to help alleviate discomfort associated with long sitting hours.

While the invention has been disclosed in its preferred forms, it will be apparent to those skilled in the art that many modifications, additions, and deletions can be made therein without departing from the spirit and scope of the invention and its equivalents as set forth in the following claims.

What is claimed is:

1. An apparatus comprising:

(a) a top portion;

(b) a crossing bottom assembly having first and second end panels and a plurality of crossing members;

(c) attachment means to attach said first and second end panels to said top portion, and said plurality of crossing members to said first and second end panels, (d) releasably securing means to releasably secure each said crossing member into an assembled configuration; and (e) fastening means to fasten said bottom crossing assembly into a releasably secured carrying configuration, wherein said apparatus folds into the releasably secured carrying configuration no larger than a top panel of said top portion, wherein said crossing bottom assembly is attached to said top portion by said attachment means, said top panel comprises a top face and a bottom face, and at least one of said plurality of crossing members is attached to said first end panel and at least one of said plurality of crossing members is attached to said second end panel, by said attachment means.

2. The apparatus of claim 1, wherein said top portion is generally square shaped.

3. The apparatus of claim 1, wherein said attachment means is selected from the group consisting of folds, staples, sewing, and adhesives.

4. The apparatus of claim 3, wherein said apparatus is foldably assembled from a flat blank having a thickness.

5. The apparatus of claim 4, wherein said releasably securing means comprises a slot provided in each said crossing member, wherein said slot is generally rectangular, having a width that is slightly greater than twice the thickness of said blank, and having a length slightly greater than the width of said crossing members.

6. The apparatus of claim 5, wherein said fastening means is selected from the group consisting of hook and loop fasteners, snaps, tapes, and clips.

7. The apparatus of claim 6, wherein said top portion has a top edge, a bottom edge, and first and second side edges;

wherein each of said first and second end panels has a top edge, a bottom edge, and first and second side edges;

wherein each of said plurality of crossing members has a top edge, a bottom edge, and first and second side edges;

wherein said top edge of said top portion is foldably attached to said bottom edge of said first end panel, and said bottom edge of said top portion is foldably attached to said top edge of said second end panel; and wherein said first side edges of said plurality of crossing members are foldably attached, one each, to said first and second side edges of said first and second end panels.

8. The apparatus of claim 7, wherein each said slot of said crossing member is generally located such that it will cooperate with each other said slot upon assembly of said apparatus.

9. The apparatus of claim 4 further comprising at least one bottom panel attached to said top panel by said attaching means.

10. The apparatus of claim 4, wherein said apparatus is fabricated from a material comprising a corrugated plastic substrate.

11. The apparatus of claim 4, wherein said apparatus is fabricated from a material comprising laminated corrugated paperboard wherein the inner and outer surfaces of said material are coated with a plastic film.

12. The apparatus of claim 11, wherein said plastic film is bonded to said surfaces of said apparatus by a bonding agent.

13. The apparatus of claim 12, wherein said plastic film is selected from the group consisting of polyester, polypropylene, polyethylene, and high impact polystyrene.

14. A unitary blank for foldably constructing a footstool, said blank comprising:

(a) a top panel;

(b) first and second end panels foldably connected to two opposing sides of said top panel;

(c) four crossing members, each said crossing member foldably attached to a side of each said end panel;

(d) at least one bottom panel foldably connected to said top panel;

(e) a slot provided in each said crossing member, wherein said slot is generally rectangular, having a width that is slightly greater than twice the thickness of said blank, and having a length slightly greater than the width of said crossing members; and (f) fastening means to fasten said crossing members to each other, wherein said blank is fabricated from a material selected from the group comprising corrugated plastic substrate and laminated corrugated paperboard.

15. The blank of claim 14, wherein said blank is cut from a generally flat sheet of said material, and wherein said blank has two faces.

16. The blank of claim 15, wherein a plastic film is bonded to said faces of said blank by a bonding agent.

17. The blank of claim 16, wherein said plastic film is selected from the group consisting of polyester, polypropylene, polyethylene and high impact polystyrene.

18. The blank of claim 17, wherein said bonding agent is a mixture of low density polyethylene and a small amount of high density polyethylene.

* * * * *